US005359811A

United States Patent [19]

Klippert

[11] Patent Number: 5,359,811

[45] Date of Patent: Nov. 1, 1994

[54] CABLE MECHANISM FOR RAISING AND LOWERING WINDOWS OF MOTOR VEHICLES

[75] Inventor: Uwe Klippert, Oberaula, Germany

[73] Assignee: Brose Fahrzeugteile GmbH & Co. Kommanditgesellschaft, Coburg, Germany

[21] Appl. No.: 945,518

[22] Filed: Sep. 16, 1992

[30] Foreign Application Priority Data

Sep. 16, 1991 [DE] Germany ..... 4131100

[51] Int. Cl.[5] ..... E05F 11/48

[52] U.S. Cl. ..... 49/352

[58] Field of Search ..... 49/348, 349, 352

[56] References Cited

U.S. PATENT DOCUMENTS

| | | | |
|---|---|---|---|
| 4,001,971 | 1/1977 | Gobush et al. | 49/352 |
| 4,494,336 | 1/1985 | Ishii et al. | 49/352 |
| 4,657,523 | 4/1987 | Chevance et al. | 49/352 X |
| 4,660,325 | 4/1987 | Bauer et al. | 49/352 |
| 4,905,412 | 3/1990 | Srock et al. | 49/352 |
| 5,067,281 | 11/1991 | Dupuy | 49/352 X |

FOREIGN PATENT DOCUMENTS

| | | | |
|---|---|---|---|
| 1199784 | 12/1959 | France | 49/352 |

*Primary Examiner*—Peter M. Cuomo
*Assistant Examiner*—Jerry Redman
*Attorney, Agent, or Firm*—Nils H. Ljungman & Associates

[57] ABSTRACT

A mechanism for raising and lowering a vehicle window pane by way of a cable attached thereto, can have at least one drive apparatus, a window pane carrier connected to the window pane and a cable guide roller for guiding a closed cable loop. Because of the various loads applied on the different segments of the cable loop of such a system, the cable can have at least two segments whose respective load ratings correspond to the loads on the corresponding segments.

13 Claims, 6 Drawing Sheets

CABLE MECHANISM FOR RAISING AND LOWERING WINDOWS OF MOTOR VEHICLES

BACKGROUND OF THE INVENTION

1. Field of the Invention

This invention relates to a mechanism for raising and lowering vehicle window panes by means of a cable. Such mechanisms generally include a carrier element attached to the window pane, to which carrier element the cable is attached, and a drive mechanism for moving the cable to thereby raise or lower the window.

2. Background of the Invention

The cable of a cable window winding mechanism is generally subjected to a variety of stresses which result from the configuration of the cable path.

Probably the most prominent stress on the cable is the tensile stress. The tensile stress is a function of the weight of the window pane, the friction conditions in the guides of the window pane, and the type of cable guides. However, in addition to the tensile stress, a bending stress, as well as a surface pressure also can typically occur at the guide pulleys.

The magnitude of the bending stress is, in particular, a function of the diameter of the guide rollers, which can be, for example, guide pulleys, and of the diameter of the cable drum of the drive mechanism. In addition, the style of the cable can also determine its bending stress.

The magnitude of the surface pressure, on the other hand, is a function of the respective tensile load and the contact surface in the cable grooves of the cable drum or of the guide pulleys. Likewise, the style of the cable can also determine its surface pressure.

Moreover, the cable can also be stressed by torsion and friction, whereby the latter typically occurs when rigid guides or deflection guides are used.

In cable window winding mechanisms of the prior art, onepiece, closed cable loops or cable loops consisting of several cable segments are generally used, whereby the selection of the cable quality is typically determined as a function of the anticipated maximum load, and the entire cable, or pieces thereof, are generally made of a material which can withstand this anticipated maximum load. Accordingly, cables of the prior art have therefore, always been oversized in segments of the cable to which only low stresses are applied.

OBJECT OF THE INVENTION

The object of the present invention is to create a cable mechanism for the opening and closing of windows of a motor vehicle, which cable mechanism, without reducing its load rating or service life, can be manufactured more economically than other known types of cable window winding mechanisms.

SUMMARY OF THE INVENTION

The solution according to the present invention provides an improved cable mechanism for the opening and closing of windows of motor vehicles, such as the windows mounted in the doors of automobiles and trucks. However, such a cable mechanism could also be used for other windows, if desired, such as house windows, etc., if mechanical operation of the house windows were desired, or for moving any other type of device which is moved back and forth between a first position and a second position wherein the load requirements on the cable are different over various sections of the cable.

The cable mechanism according to the present invention allows for the elimination of the added expense necessarily incurred as a result of the use of a cable with a single, undifferentiated strength. The cable window winding mechanism according to the present invention, in which the cable is preferably manufactured to have segments of different load capacities, can be manufactured more simply and economically than other similar cable window winding mechanisms, while not adversely affecting either its total load rating or its useful life.

In general, the term "load rating" as used in this context essentially refers to the material characteristics, the sizing, and the overall construction of the cable or of the cable segment.

In one advantageous embodiment of the solution according to the present invention, the segment with the maximum load rating can preferably extend at least from a first window carrier piece, or carrier dog, to a position of the cable loop located between an upper guide pulley and the drive apparatus. This point is preferably not subjected to any bending stress, either in the lower limit position, or in the upper limit position of the window carrying piece.

As a result of this configuration, only the cable segment which is generally subjected to the maximum stress can be designed with the highest cable load rating for the maximum load. The remaining segment, or segments, of the cable loop can preferably be made from one or more cables having lower quality or strength. In this manner, the material costs incurred in equipping the cable window winding mechanism can be significantly reduced.

An additional advantageous embodiment of the solution according to the present invention is characterized by the fact that when two segments of different and suitable load ratings are used, the segment with the lower load rating can preferably extend:

a) from the point of the cable loop located between the upper guide pulley and the drive apparatus, which point is not subjected to a bending stress either in the upper limit position or in the lower limit position of the first dog, or b) from the drive apparatus, or c) with a double-leg design of the cable window winding mechanism, from a second carrier or dog, via guide pulleys and possibly via the drive apparatus, a lower guide pulley and/or the second dog, to the first dog.

Such a configuration can essentially make possible, a very significant reduction of the cable costs in various models of cable window winding mechanisms, without reducing their load rating or service life.

In an additional advantageous embodiment of the solution according to the invention, when three segments having suitable load ratings are used, there can preferably be a segment with a medium load rating adjacent to the segment with the maximum load rating, and adjacent to the section of medium load rating, on the other end, there can be a segment with a lowest load rating.

This configuration, in particular on double-leg cable window winding mechanisms, can make possible an additional reduction of costs, without reducing the operational reliability of the cable window winding mechanism. In such a configuration, the change of load ratings, or connection of the various cable segments, can preferably be made at the cable drum drive, on the dogs connected to the window pane, or at the point which lies between the upper guide pulley and the drive apparatus of the cable loop, which point is preferably not subjected to a bending stress either in the lower or upper limit position of the dogs.

Accordingly, in another additional advantageous embodiment of the solution according to the present invention, a segment having a medium load rating can preferably extend:

a) from a point of the cable loop located between an upper guide pulley and the drive apparatus, which point is not subjected to a bending stress either in the upper limit position or in the lower limit position of the first dog,
   aa) to the drive apparatus, or
   bb) on a double-leg model of the cable window winding mechanism, via the drive apparatus to a second dog, or
b) on a double-leg model of the cable window winding mechanism, from the drive apparatus to the second dog, adjacent to which segment of medium load rating there can be a segment of lower load rating, and which closes the cable loop to the first dog.

An additional advantageous embodiment of the solution according to the present invention is characterized by the fact that with a double-leg model of the cable window winding mechanism, and when four segments with different and appropriate load ratings are used, the segment with the second-highest load rating preferably extends from a point of the cable loop between an upper guide pulley and the drive apparatus, which point is not subjected to a bending stress either in the lower limit position or in the upper limit position of the first dog, to the drive apparatus, the segment with the third-highest load rating preferably extends from the drive apparatus to the second dog, and the segment with the lowest load rating extends from the second dog back to the first dog.

As a result of this configuration, an optimal cost reduction can be achieved on a double-leg cable window winding mechanism, in particular by taking advantage of the existing fastening points, to make the change from one load rating to another.

In summary, one aspect of the invention resides broadly in a device for raising and lowering a window pane of a window of a motor vehicle, the window pane having a maximum raised position to fully close the window and a maximum lowered position to fully open the window, with the maximum raised position and the maximum lowered position defining a first distance therebetween. The device comprises: a first carrier element for being attached to the window pane; a cable for being attached to the first carrier element for moving the first carrier element to move the window pane over the at least a portion of the first distance; and a drive apparatus for moving the cable to move the first carrier element. The cable has at least a first segment and a second segment, with the first segment having a first load rating and the second segment having a second load rating, and the first load rating being greater than the second load rating.

BRIEF DESCRIPTION OF THE DRAWINGS

The preferred embodiments of the present invention are explained in greater detail below, with reference to the accompanying figures, in which.

DESCRIPTION OF THE PREFERRED EMBODIMENTS

Figure 1B:
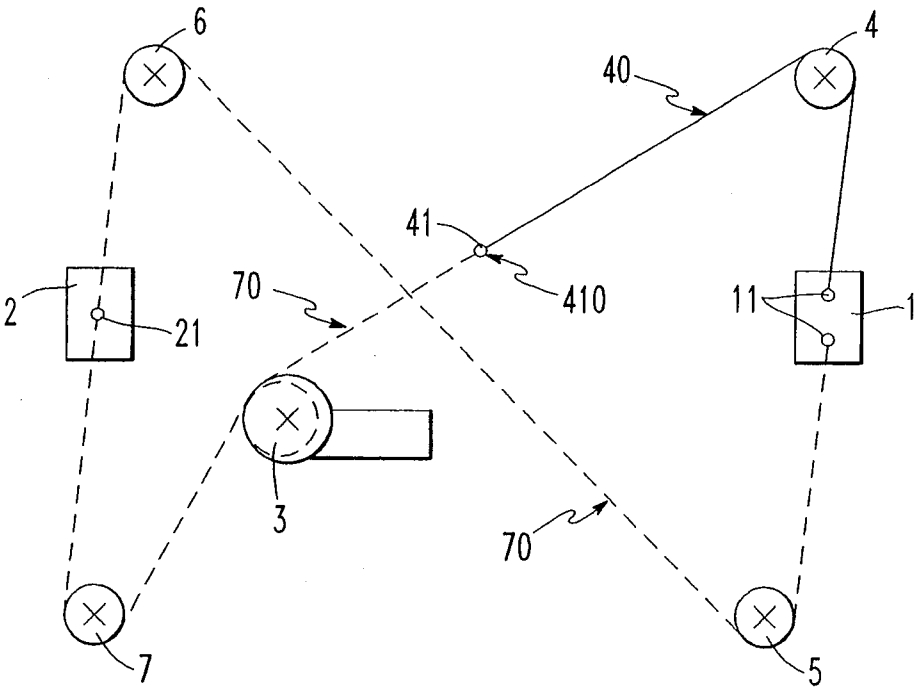
FIGS. 1*b*, 2*b* and 4 are schematic diagrams of double-leg cable window winding mechanisms with two segments of different and appropriate load ratings.
Figure 1A:
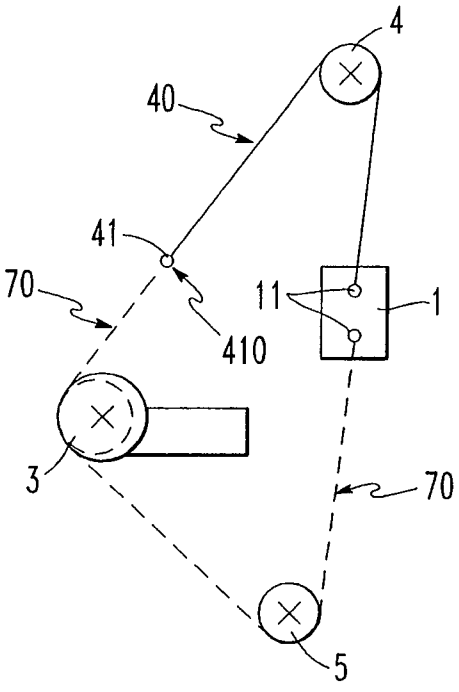
FIGS. 1*a* and 2*a* are schematic diagrams of single-leg cable window winding mechanisms with two segments of different and appropriate load ratings.

FIG. 1*a* is a schematic illustration of a single-leg cable window winding mechanism which preferably has a cable loop which can be guided over a lower guide roller 5 and an upper guide roller 4, and can be wound friction-tight around a drum of a drive apparatus 3. The cable loop preferably has two segments 40, 70 of different load ratings, whose respective strengths can be selected so that the strengths correspond to the stresses occurring within these segments, which strengths essentially do not significantly exceed the required strength for each segment.

To connect the two segments 40 and 70 there can preferably be a clamp element 41, into which clamp element 41 one end of each of the segments 40 and 70 can be inserted or squeezed, and then clamped.

The cable ends of the cable loop are preferably fastened into the window carrier plate, or dog 1, which plate can preferably be directly connected to the window pane (not shown in any further detail). To make possible a rapid and easy installation of the cable loop, the ends of the cable loop can preferably be equipped with couplings which can be secured in corresponding securing devices 11 of the dog 1.

The highest tensile load in the cable usually occurs in the segment of the cable loop which extends from the dog 1 via the guide roller 4 to the drive apparatus. A high tensile load is experienced in particular as the window is being closed, that is, when the window is being raised against the force of gravity and against the friction forces which occur inside the window guides. The maximum tensile load generally occurs when the window pane is completely raised and pressed against the upper stop.

On the other hand, the cable segment guided via the bottom guide roller 5 is generally only subjected to tension when, as the window is lowered, friction forces inside the window guides must be overcome or when the window pane is completely lowered and pressed against the bottom stop.

In addition to the relatively high tensile load in the cable segment which is guided over the top guide roller 4, this cable segment also typically must experience a bending stress as it passes over the curve of the roller 4, as well as a surface pressure as it contacts the roller 4, so that in total, the segment 40, which extends from the dog 1 to the point 410 at the clamp 41 between the upper guide roller 4 and the drive apparatus 3, is generally subjected to the highest load.

The segment 40 should therefore preferably be a high-strength or high-quality cable which is designed or sized to withstand the maximum load which can occur. The remaining segment of the cable loop generally can have a lower load rating and can therefore preferably be sized in accordance with the maximum load that occurs in segment 70 of the cable loop.

FIG. 1*b* shows a double-leg cable window winding mechanism with a cable loop which has two segments 40, 70 with different load ratings. The segment 40 with the highest load rating can be fastened on one end to the first dog 1, guided over the top guide roller 4 and can be connected by means of the clamp element 41 to the segment 70, which will generally have a lower load rating.

The segment 70 of the cable loop can preferably be, in turn, frictionally connected to the drive apparatus 3, which can preferably be driven by an electric motor, but which could also be manually operated and drive by a hand crank. From the drive apparatus 3, the segment 70 preferably runs via a lower guide roller 7 to a second dog 2, and via two additional guide rollers 6, 5 back to the first dog 1, where it essentially completes and closes the cable loop.

The guide rollers 4, 5, 6, 7 can preferably be located so that the dogs 1, 2 can be moved essentially parallel to one another from a lower limit position to an upper limit position and vice versa. Thus, such a configuration as shown in FIG. 1*b* could be used, for example, to raise and lower larger windows for which one dog 1 may be insufficient.

On a double-leg cable window winding mechanism, it should be noted that the tensile load in segment 40 of the cable loop, when the window is being raised, can be approximately twice the tensile load which occurs in segment 70. Consequently, the segment 70 can have a much lower load rating than segment 40, without thereby adversely affecting the operational reliability of the cable window winding mechanism.

Figure 2B:
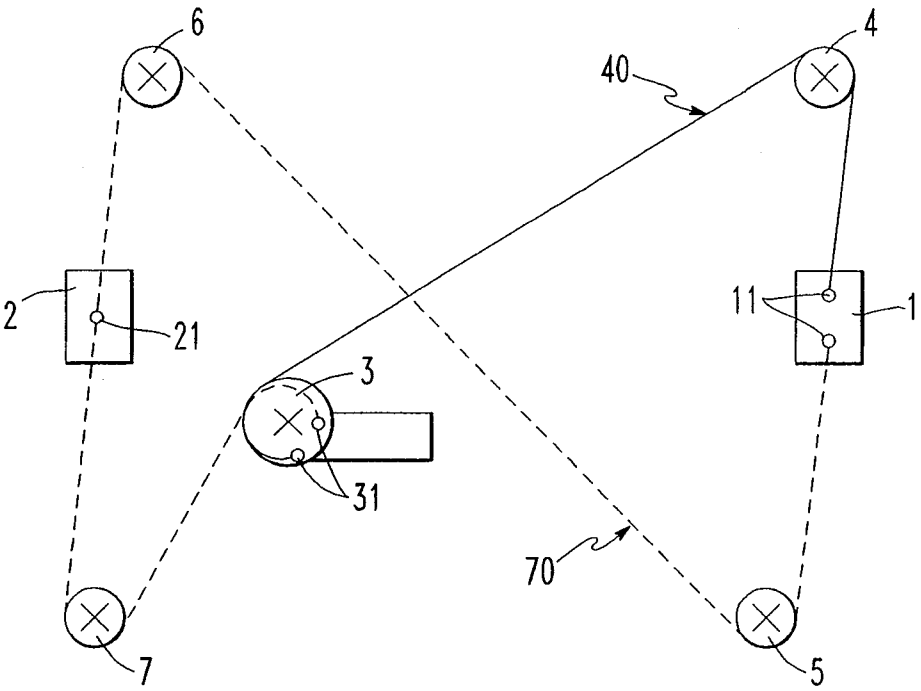
Figure 2A:
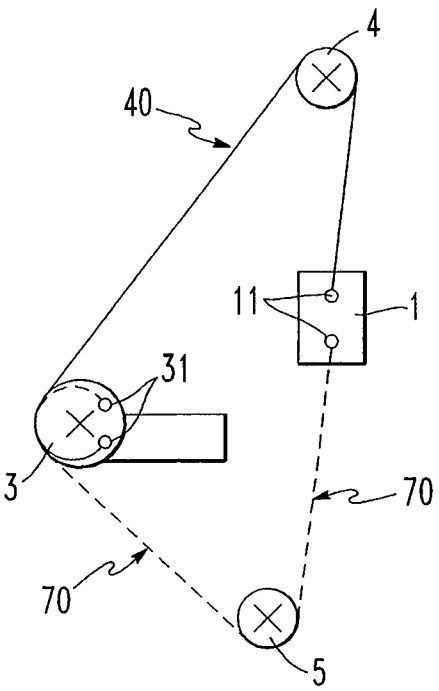

FIG. 2*a* shows a single-leg cable window winding mechanism, in which segment 40 with a high load rating, in contrast to the embodiment illustrated in FIG. 1*a*, preferably runs from the dog 1 via the upper guide roller 4 to the drive apparatus 3. The segment 70 with the lower load rating can thus be correspondingly shorter in this example, and can extend from the drive apparatus 3 via the bottom guide roller 5 to the dog 1. The ends of the cable segments 40, 70, which ends are preferably connected to the drive apparatus 3, can preferably have couplings which can be secured to the drive apparatus 3 by securing devices 31, so that one of the segments 40, 70 can be wound up on the drive apparatus 3 when the drive apparatus 3 is activated, while the other segment is being unwound.

FIG. 2*b* shows a double-leg cable window winding mechanism on which, as in the embodiment illustrated in FIG. 2*a*, a segment 40 with a high load rating is preferably fastened to the dog 1 and extends via the upper guide roller 4 to the cable drum of the drive apparatus 3. Fastened to the cable drum, in the direction opposite to the winding direction of the segment 40, is preferably the segment 70 with the lower load rating. This latter segment preferably runs via the lower guide roller 7 to the upper guide roller 6, and then via the second lower guide roller 5 to the dog 1, whereby between the guide rollers 6 and 7 there can be a second dog 2, which can be connected to the cable loop, for example, by means of a cable clamp 21.

Figure 3:
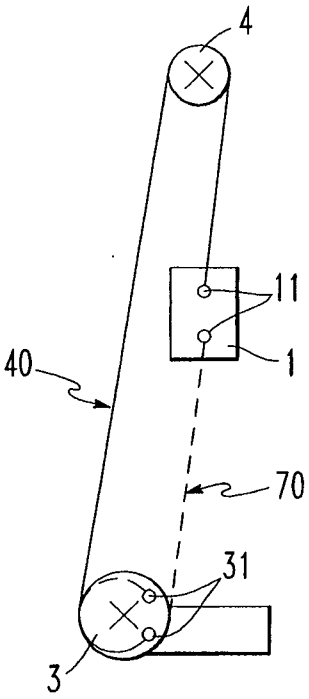
FIG. 3 is a schematic diagram of a single-leg cable window winding mechanism with two segments of different and appropriate load ratings, the lower guide of which is formed by means of a drive apparatus.

FIG. 3 shows a single-leg cable window winding mechanism with only one guide roller 4 and two cables 40 and 70 with different load ratings, which two cables 40 and 70 can preferably have couplings on their ends for being fastened into securing devices, or clamps 11 in the dog 1, or clamps 31 in the cable drum of the drive apparatus 3. In this embodiment, the cable with the higher load rating, what is cable 40, preferably can run from the drive apparatus 3 via the upper guide roller 4 to the dog 1, from which point the cable with the lower load rating, cable 70, can run directly to the drive apparatus 3, thereby closing the cable loop.

Figure 4:
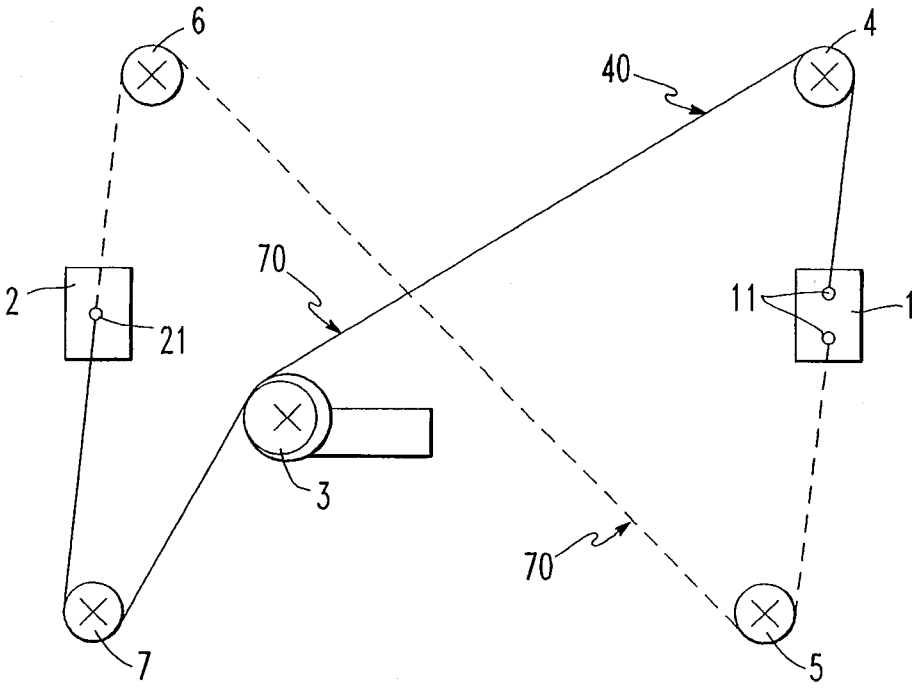

FIG. 4 shows an additional embodiment of a double-leg cable window winding mechanism with two segments 40, 70 which have different load ratings. In contrast to the embodiments illustrated in FIGS. 1*b* and 2*b*, the segment 40 having the high load rating can preferably extend from the first dog 1 via the upper guide roller 4 on to the drive apparatus 3, whereby the cable loop can be wound friction-tight around the cable drum of the drive apparatus 3, and via the lower guide roller 7 to the second dog 2. In the dogs 1 and 2, there can also be securing devices 11, 21 in which the ends of the segments 40 and 70, provided with appropriate couplings, can be secured for fastening the segments 40 and 70 to the dogs 1 and 2.

In addition to the division of the cable loop into two different segments having the different load ratings as described above, a division into three such segments can also easily be done.

Figure 5B:
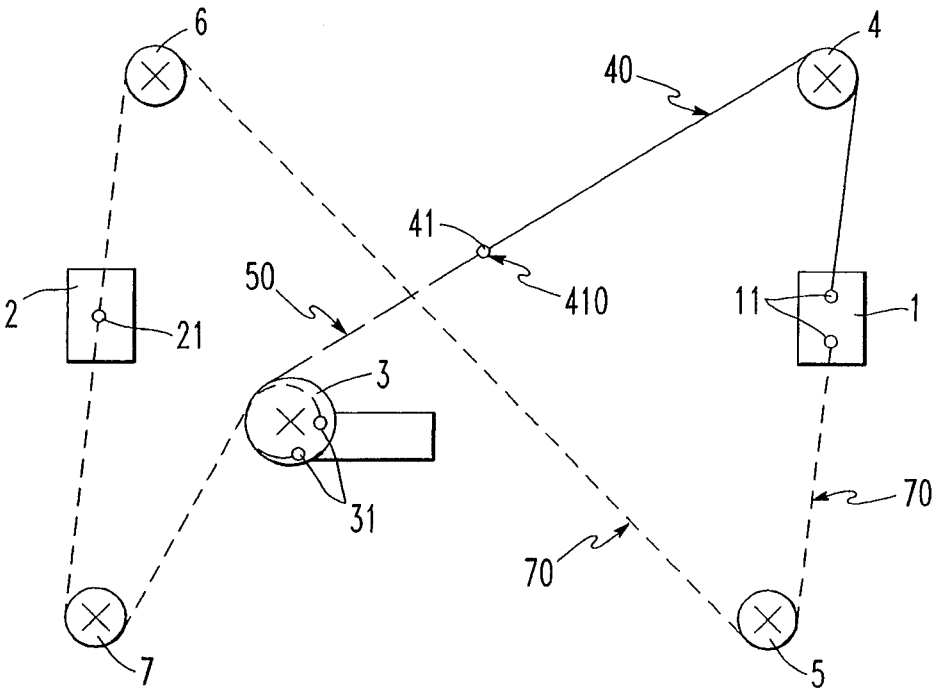
FIGS. 5*b*, 6 and 7 are schematic diagrams of double-leg cable window winding mechanisms with three segments of different and appropriate load ratings.
Figure 5A:
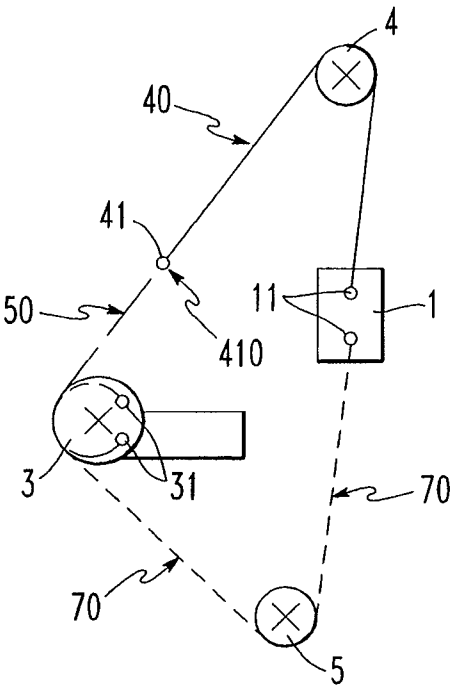
FIG. 5*a* is a schematic diagram of a single-leg cable window winding mechanism with three segments of different and appropriate load ratings.

FIG. 5*a* shows a single-leg cable window raising mechanism with three segments 40, 50, 70 having different load ratings, whereby adjacent to the segment 40, having the highest load rating, can be a segment 50 having a medium load rating, and adjacent to the segment 50, on the opposite end, can be a segment 70 having a low load rating.

The segment 40 with the highest load rating can preferably be fastened on one end to the dog 1, and can run over the upper guide roller 4 to the point 410 on clamp 41, which point 410 is preferably not subjected to a bending stress either in the lower limit position of the dog 1 or in the upper limit position of the dog 1. The segments 40 and 50 can be connected to one another by means of the clamp element 41, which can consist, for example, of a two-sided cable coupler, in which the separated wires of the cable end are inserted and fastened by means of a sealing compound. The clamp element 41 can also preferably be designed as a tensioning device, by means of which the required cable tension can be set.

The other end of the segment 50, which segment has the medium load rating, can be fastened to the cable drum of the drive apparatus 3 by the securing device 31. In the same manner, but wound in the other direction, the segment 70 which has the lowest load rating and which extends over the lower guide roller 5 to the dog 1, can also be fastened to the cable drum.

For fastening the respective cable ends to the dogs or to the cable drum, wedge locks, a gib and cotter, or cable clamps could also be used, instead of securing devices.

FIG. 5*b* shows the use of three segments 40, 50, 70 with different load ratings on a double-leg cable window winding mechanism. Segment 70 having the lowest load capacity corresponds essentially to the segment 70 in the embodiment illustrated in FIG. 2*b*. The segment 40 with the highest load rating, in contrast to the cable window winding mechanism illustrated in FIG. 2*b*, can run only to the point 410 located between the upper guide roller 4 and the drive apparatus 3, which point 410 is preferably not subjected to a bending stress either in the bottom limit position or in the upper limit position of the first dog 1. The segment 50 having the medium load rating can preferably be connected to the cable 40 at point 410, and this segment 50 can preferably run to the drive apparatus 3.

The positioning of the limit of the segment 40, with the highest load rating, at point 410 can be based on the following: in general, a vehicle window is opened all the way less frequently than it is only partly lowered, consequently, the area of the cable segment which, when the window is closed, is in contact with the upper guide roller 4 is subjected to bending stress more frequently than the area of the segment which is in contact with the upper guide roller 4 when the window is lowered all the way.

Preferably, at least the segment 40 having the highest load rating can consist of a long lay cable which, compared to cross lay cables, is characterized by a lower internal friction and has a larger contact surface in the cable grooves of the pulleys or the cable drum.

Figure 7:
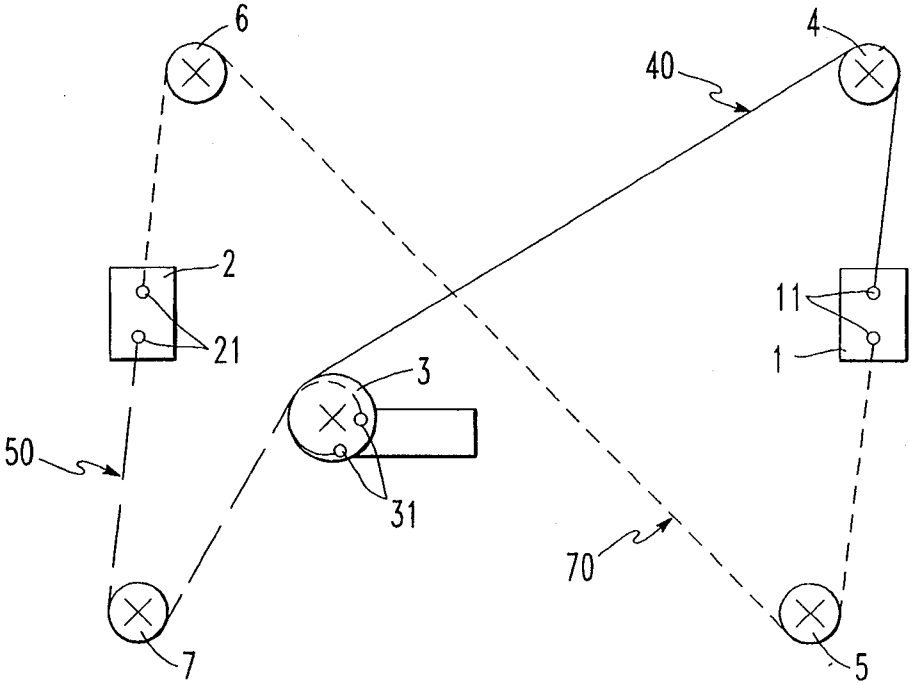
Figure 6:
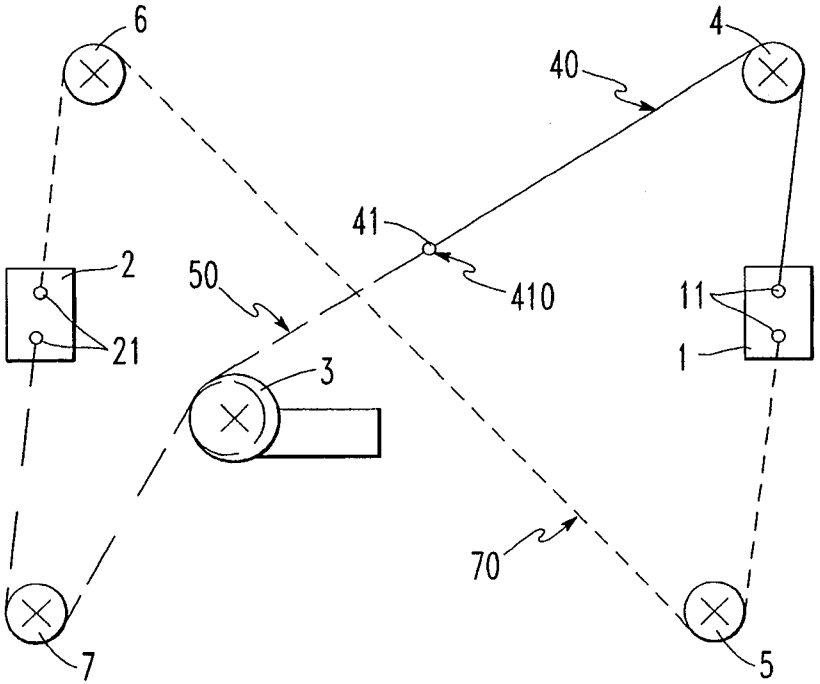

Two additional variants of a double-leg cable window winding mechanism having three segments 40, 50, 70 with different load ratings are illustrated in FIGS. 6 and 7.

The variant illustrated in FIG. 6 is the same as the embodiment illustrated in FIG. 5*b* with regard to the path of the segment 40 having the highest load rating. However, in this embodiment, the segment 50 with the medium load rating is laid friction-tight around the cable drum of the drive apparatus 3 and continued over the bottom guide roller 7 to the second dog 2. The segment 70 with the lower load rating is connected to the dog 2, and extends via the guide rollers 6 and 5 to the first dog 1.

In the other variant of FIG. 7, by contrast, the segment 40 with the highest load rating extends from the first dog 1 via the upper guide roller 4 to the drive apparatus 3. At the drive apparatus 3, the cable continues with the segment 50 having the medium load rating, which in turn extends to the second dog 2. The segment 70 having the lower load rating runs like the variant illustrated in FIG. 6, via the guide rollers 6 and 5 back to the first dog 1.

Figure 8:
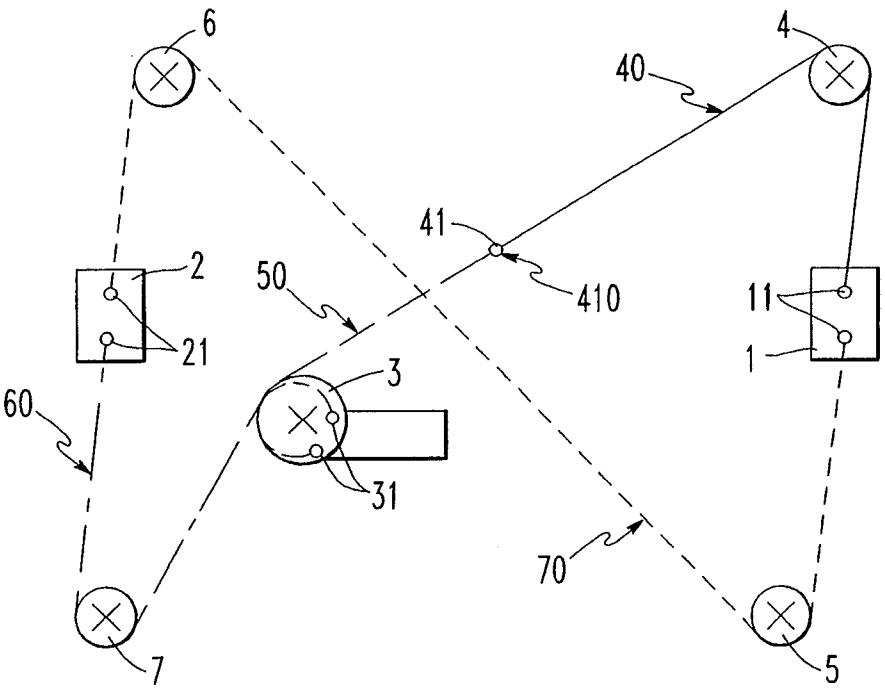
FIG. 8 is a schematic diagram of a double-leg cable window winding mechanism with four segments of different and appropriate load ratings.

FIG. 8 shows that a double-leg cable window winding mechanism according to the invention can also be easily equipped with four segments, each with different load ratings that correspond to the loads exerted on the respective segments. The cable loop thereby has one segment 40 having the highest load rating, which is fastened on one end to the first dog 1, and which extends via the upper guide roller 4 to point 410 of the cable loop, which point 410 is not subjected to a bending load by the upper guide roller 4 or by the cable drum of the drive apparatus 3, either during raising or lowering of the window connected to the dogs 1, 2.

Connected at point 410 of the cable loop is preferably the segment 50 having the second-highest load rating, which segment 50 preferably extends to the drive apparatus 3, where the cable 50 can be fastened to cable drum.

According to the invention, the segment 60 having the third-highest load rating can also be fastened to the cable drum of the drive apparatus, in the opposite direction of winding to the cable segment 50. This segment 60 can run via the lower guide roller 7 to the second dog 2, where finally the segment 70 having the lowest load rating can be fastened, which segment 70 can then preferably extends via the guide rollers 6 and 5 back to the first dog 1.

Figure 9:
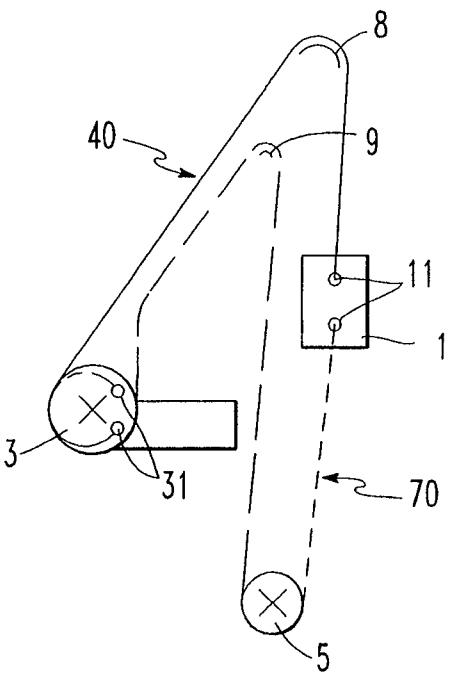
FIG. 9 is a schematic diagram of a cable window winding mechanism with two segments of different and appropriate load ratings and deflector guides in the form of friction guides.

FIG. 9 shows a single-leg cable window winding mechanism with two segments 40, 70 with different load ratings corresponding to the loads on the respective segments. This embodiment also preferably includes a friction guide 8 instead of a guide roller. The segment 40 can thus extend from the dog 1 via the friction guide 8 to the drive apparatus 3. This segment 40 also preferably consists of a high quality cable, which is sized with particular regard to the friction stress encountered in the friction guide 8.

The segment 70, which has the lower load rating, can run from the dog 1 via the lower guide roller 5 and a second friction guide 9 located preferably underneath the upper friction guide 8 to the drive apparatus 3.

It is also conceivable that the cable window winding mechanisms illustrated in FIGS. 1*a* to 8 could each be equipped partly or even completely with friction guides instead of guide rollers.

One feature of the invention resides broadly in the cable window winding mechanism for raising and lowering a vehicle window pane with at least a drive apparatus, a dog connected to the window pane and a cable guide roller to guide a closed cable loop, characterized by the fact that the cable loop has at least two segments 40, 50, 60, 70 with different load ratings.

Another feature of the invention resides broadly in the cable window winding mechanism, characterized by the fact that the load rating of the cable corresponds to the load on the respective segment of the cable loop.

Yet another feature of the invention resides broadly in the cable window winding mechanism, characterized by the fact that the segment 40 with the highest load rating extends at least from a first dog 1 to a point 410 of the cable loop between an upper guide pulley 4 and the drive apparatus 3, which is not subjected to a bending stress either in the lower limit position or in the upper limit position of the first dog 1.

Still another feature of the invention resides broadly in the cable window winding mechanism, characterized by the fact that when two segments 40, 70 with different load ratings are used, the segment 70 with a lower load rating extends:

a) from the point 410 of the cable loop located between the upper guide pulley 4 and the drive mechanism 3, which is not subjected to a bending stress either in the upper limit position or in the lower limit position of a first dog 1, or b) from the drive apparatus 3, or c) with a double-leg design of the cable window winding mechanism from a second dog 2 via guide roller 6, 5 and possibly via the drive apparatus 3, a lower guide roller 7 and/or the second dog 2, to the first dog 1.

Another feature of the invention resides broadly in the cable window winding mechanism, characterized by the fact that when three segments 40, 50, 70 with suitable load ratings are used, adjacent to the segment 40 with the highest load rating is a segment 50 with a medium load rating, and adjacent to the latter is the segment 70 with the lowest load rating.

Yet another feature of the invention resides broadly in the cable window winding mechanism, characterized by the fact that a segment of medium load rating extends:

a) from a point 410 of the cable loop located between an upper guide pulley 4 and the drive apparatus 3, which is not subjected to a bending stress either in the upper limit position or in the lower limit position of the first dog 1,
   aa) to the drive apparatus 3, or
   bb) on a double-leg model of the cable window winding mechanism, via the drive apparatus 3 to a second dog 2, or
b) on a double-leg model of the cable window winding mechanism, from the drive apparatus 3 to a second dog 2, adjacent to which there is a segment 70 with a lower load rating, and closes the cable loop to the first dog 1.

Still another feature of the invention resides broadly in the cable window winding mechanism, characterized by the fact that with a double-leg model of cable window winding mechanism, and when four segments 40, 50, 60, 70 with suitable load ratings are used, the segment 50 with the second-highest load rating extends from a point 410 of the cable loop between an upper guide pulley 4 and the drive apparatus 3, which is not subjected to a bending stress either in the lower limit position or in the upper limit position of the first dog 1, to the drive apparatus 3, the segment 60 with the third-highest load rating extends from the drive apparatus 3 to a second dog 2, and the segment 70 with the lowest load rating extends from the second dog 2 to the first dog 1.

Another feature of the invention resides broadly in the cable window winding mechanism, characterized by the fact that the segments 40, 50, 60, 70 with different load ratings are connected to the dog or dogs 1, 2, and are fastened to the drive apparatus 3 and/or by means of at least one clamp element 41 to one another.

Still another feature of the invention resides broadly in the cable window winding mechanism, characterized by the fact that the dog or dogs 1, 2 and/or the drive apparatus 3 can be secured by means of securing devices 11, 21, 31 and the ends of the segments 40, 50, 60, 70 with different load ratings are provided with couplings which can be secured in securing devices 11, 21, 31.

Yet another feature of the invention resides broadly in the cable window winding mechanism, characterized by the fact that the clamp element 41 has a tensioning device.

Another feature of the invention resides broadly in the cable window winding mechanism, characterized by the fact that at least the segment 40 with the highest load rating consists of a long lay cable.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A device for raising and lowering a window pane of a window of a motor vehicle, the window pane having a maximum raised position to fully close the window and a maximum lowered position to fully open the window, said maximum raised position and said maximum lowered position defining a first distance therebetween, and said device comprising:

first and second carrier means attached to the window pane and spaced apart from one another, said first and second carrier means being configured for movement along with, and parallel to one another;

a cable for being attached to said first and second carrier means for moving said first and second carrier means to move the window pane over at least a portion of the first distance;

first and second cable guide means for guiding movement of said cable during raising and lowering of the window pane, said first and second carrier means being movable towards said first and second guide means during raising of the window pane, and said first and second carrier means being movable away from said first and second guide means during lowering of the window pane;

said cable forming a closed cross-over loop extending from said first carrier means over said first guide means to said second carrier means and from said second carrier means over said second guide means back to said first carrier means;

said cable having at least a first segment and a second segment, said first segment extending from said first carrier means to said first guide means, said first segment passing over said first guide means during raising and lowering of the window;

said first segment bearing a load of the window pane during at least the raising of the window pane and said second segment bearing a load of the window pane during at least the lowering of the window pane;

said load during raising the window pane being greater than said load during lowering the window pane;

said first segment having a first load rating and said second segment having a second load rating; and said first load rating being greater than said second load rating.

2. The device according to claim 1, wherein:

said device further comprises drive means for moving the cable to move said first and second carrier means, said cable means defining a path of travel;

said device further comprises third and fourth guide means disposed opposite to said first and second guide means for movement of said carrier means towards said first and second guide means during lowering of the window pane;

said first carrier means being disposed between said fourth and first guide means and said second carrier means being disposed between said third and second guide means;

said first guide means being disposed between said first carrier means and said drive means along said path of travel;

said third guide means being disposed between said drive means and said second carrier means along said path of travel;

said second and fourth guide means being disposed between said second and first carrier means along said path of travel;

said second cable segment passing over at least said second and fourth guide means during raising and lowering of the window pane;

said first cable segment has a first end and a second end;

said second cable segment has a first end and a second end;

said first end of said first segment for being attached to said first carrier means;

said first end of said second segment for being attached to said first carrier means;

each of said second end of said first segment and said second end of said second segment for being attached at one of:

said drive means; and said second end of the other of said first segment and said second segment at a position between said first guide means and said drive means;

said position between said first guide means and said drive means for being maintained between said first guide means and said drive means during raising and lowering of the window pane; and said first segment bearing a load of the window pane solely during at least the raising of the window pane.

3. The device according to claim 2, wherein:

said cable comprises at least a third segment disposed between said first and second segments at one of:

between the second end of said first segment and said drive means, with said second segment extending from said drive means to said second carrier means and from said second carrier means to said first carrier means, and said first segment extending from said first carrier means to said third segment at a position between said first guide means and said drive means; and between said drive means and said second carrier means, with said second segment extending from said second carrier means to said first carrier means, and said first segment extending from said first carrier means to said drive means; said third segment having a first end and a second end; said third segment having a third load rating, said third load rating being less than said first load rating and greater than said second load rating.

4. The device according to claim 3, wherein:

said first and second ends of each of said first, second, and third segments comprise couplings;

said first carrier means and said drive means comprise fastening means for receiving said couplings to attach said cable segments to said first carrier means and said drive means;

said position between said first guide means and said drive means comprises clamp means for clamping cable ends together;

said clamp means comprising tensioning means for tensioning said cable on the device;

each of said first and second guide means comprise one of:

a guide pulley, and a friction guide; and at least said first segment of said cable comprises a long-lay belt.

5. A device for raising and lowering a window pane of a window of a motor vehicle, the window pane having a maximum raised position to fully close the window and a maximum lowered position to fully open the window, said maximum raised position and said maximum lowered position defining a first distance therebetween, and said device comprising:

first carrier means for being attached to the window pane;

a cable for being attached to the first carrier means for moving the first carrier means to move the window pane over at least a portion of the first distance;

drive means for moving the cable to move the first carrier means;

said cable having at least a first segment and a second segment, said first segment having a first load rating and said second segment having a second load rating;

said first segment of said cable being configured substantially for raising the window pane and said second segment being configured substantially for lowering the window pane;

said first segment has a first load applied thereto during at least the raising of the window pane and said second segment has a second load applied thereto during at least the lowering of the window pane;

first guide means over which said first segment runs;

said first guide means having a diameter, and said first guide means being disposed between said first carrier means and said drive means;

said drive means comprising a pulley means;

said pulley means having a larger diameter than the diameter of said first guide means;

said first load for raising the window pane is greater then said second load for lowering the window pane; and said first load rating is greater than said second load rating.

6. The device according to claim 5, wherein:

said first guide means is configured for guiding movement of said first segment;

said first segment for passing over said first guide means during raising and lowering of the window pane;

said device further includes second guide means disposed between said drive means and said first carrier means for guiding movement of said second segment; and said second segment of said cable being for passing over said second guide means during raising and lowering of the window pane;

said first segment has a first end and a second end;

said second segment has a first end and a second end;
said first end of said first segment for being attached to said first carrier means;
said first end of said second segment for being attached to said first carrier means;
each of said second end of said first segment and said second end of said second segment for being attached to said second end of the other of said first segment and said second segment at a position between said first guide means and said drive means; and
said position between said first guide means and said drive means for being maintained between said first guide means and said drive means during moving of the window pane between the maximum raised position and the maximum lowered position.

7. The device according to claim 5, wherein:
said device further comprises second guide means disposed between said carrier means and said drive means said second segment passing over said second guide means during raising and lowering of the window pane;
said first segment has a first end and a second end;
said second segment has a first end and a second end;
said first end of said first segment for being attached to said first carrier means;
said first end of said second segment for being attached to said first carrier means;
each of said second end of said first segment and said second end of said second segment for being attached to said second end of the other of said first segment and said second segment at a position between said first guide means and said drive means;
said position between said first guide means and said drive means for being maintained between said first guide means and said drive means during raising and lowering of the window pane; and
said first segment bearing a load of the window pane solely during the raising of the window pane.

8. The device according to claim 7, wherein:
said cable comprises at least a third segment disposed between said second end of said first segment and said drive means;
said third segment having a first end and a second end;
said first end of said third segment for being attached to said second end of said first segment at a position between said first guide means and said drive means;
said second end of said third segment for being attached to said drive means; and
said third segment having a third load rating, said third load rating being less than said first load rating and greater than said second load rating.

9. The device according to claim 8, wherein:
said first and second ends of each of said first, second, and third segments comprise couplings;
said first carrier means and said drive means comprise fastening means for receiving said couplings to attach said cable segments to said first carrier means and said drive means;
said position between said first guide means and said drive means comprises clamp means for clamping cable ends together;
said clamp means comprising tensioning means for tensioning said cable on the device;
each of said first and second guide means comprise one of:
a guide pulley, and
a friction guide; and at least said first segment of said cable comprises a long-lay belt.

10. A device for raising and lowering a window pane of a window of a motor vehicle, the window pane having a maximum raised position to fully close the window and a maximum lowered position to fully open the window, said maximum raised position and said maximum lowered position defining a first distance therebetween, and said device comprising:
first carrier means for being attached to the window pane;
a cable for being attached to the first carrier means for moving the first carrier means to move the window pane over at least a portion of the first distance;
drive means for moving the cable to move the first carrier means;
said cable having at least a first segment and a second segment, said first segment having a first load rating and said second segment having a second load rating;
said first segment of said cable being configured substantially for raising the window pane and said second segment being configured substantially for lowering the window pane;
said first segment has a first load applied thereto during at least the raising of the window pane and said second segment has a a second load applied thereto during at least the lowering of the window pane;
said first segment means connecting said first carrier means and said drive means;
first guide means over which said first segment runs;
said first guide means being disposed between said first carrier means and said drive means;
said first load for raising the window pane is greater than said second load for lowering the window pane; and
said first load rating being greater than said second load rating.

11. The device according to claim 10, wherein:
said first guide means is for guiding movement of said first segment of said cable;
said first segment for passing over said first guide means during raising and lowering of the window pane;
said first segment has a first end and a second end;
said second segment has a first end and a second end;
said first end of said first segment for being attached to said first carrier means;
said first end of said second segment for being attached to said first carrier means; and
each of said second end of said first segment and said second end of said second segment for being attached to said drive means, said drive means being configured to wind said cable segments thereabout to move the cable.

12. The device according to claim 11, wherein:
said device further includes second guide means disposed between said drive means and said first carrier means; and
said second segment of said cable being for passing over said second guide means during raising and lowering of the window pane.

13. The device according to claim 12, wherein:

said first and second ends of each of said first and second segments comprise couplings;

said first carrying means and said drive means comprise fasteners for receiving said couplings to attach said cable segments to said first carrying means and said drive means;

each of said first and said second guide means comprise one of:

a guide pulley; and a friction guide; and at least said first segment of said cable comprises a long-lay cable.

* * * * *